United States Patent [19]

Inoue et al.

[11] 4,405,411

[45] Sep. 20, 1983

[54] RECESS ELECTRODEPOSITING METHOD, ELECTRODE ASSEMBLY AND APPARATUS

[75] Inventors: Kiyoshi Inoue, Tokyo; Makoto Onoue; Noriyoshi Otaki, both of Yokohama, all of Japan

[73] Assignee: Inoue-Japax Research Incorporated, Yokohama, Japan

[21] Appl. No.: 338,901

[22] Filed: Jan. 12, 1982

[51] Int. Cl.[3] ..... C25D 5/04; C25D 17/10

[52] U.S. Cl. ..... 204/26; 204/222; 204/DIG. 10

[58] Field of Search ..... 204/26, 222, DIG. 10

[56] References Cited

U.S. PATENT DOCUMENTS

| | | | |
|---|---|---|---|
| 3,619,384 | 11/1971 | Eisner | 204/DIG. 10 |
| 3,706,650 | 12/1972 | Eisner | 204/DIG. 10 |
| 3,751,346 | 8/1973 | Ellis | 204/26 |
| 3,922,207 | 11/1975 | Towrey, Jr. | 204/26 |

FOREIGN PATENT DOCUMENTS

| | | | |
|---|---|---|---|
| 914809 | 1/1963 | United Kingdom | 204/26 |
| 1257541 | 12/1971 | United Kingdom | 204/26 |

*Primary Examiner*—T. M. Tufariello

*Attorney, Agent, or Firm*—Karl F. Ross; Herbert Dubno

[57] ABSTRACT

A method, electrode assembly and apparatus for forming an electrodeposited metallic layer on a wall of a recess in a workpiece and at least on a bottom area in the recess. The electrode assembly comprises an electrodepositing electrode element and a support member so formed as to incorporate the electrode element therein and have a surface contour complementary to a surface contour of the recess in the workpiece. The support comprises a porous mass composed at least in part of an electrically nonconductive material and having abrasive particles distributed therein at least on the contoured surface thereof. In operation, the assembly and the workpiece are positioned to establish a mating engagement of the support member with the recess and a liquid electrolyte is supplied onto the wall of the recess. The electrode assembly is reciprocated to cyclically bring the support member in pressure contact with and away from the surface of the recess while a depositing current is passed between the electrode element and the workpiece at least during a time period in which the support member and the surface of the recess are brought together to uniformly electrodeposit a metal from the liquid electrolyte on the wall and at least on the aforesaid bottom area in the recess.

12 Claims, 8 Drawing Figures

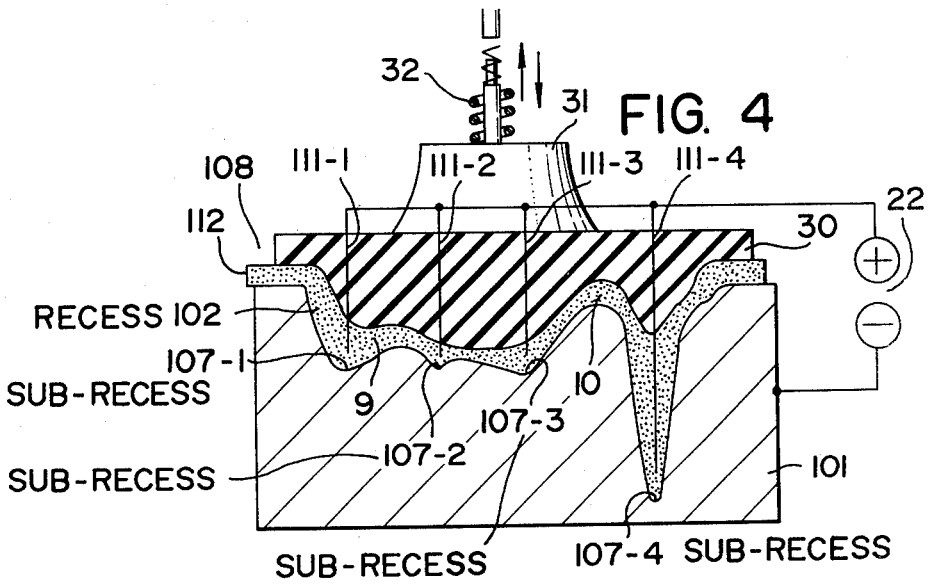
FIG. 4
FIG. 5
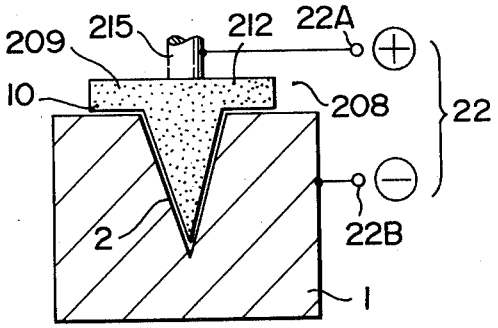
FIG. 5A
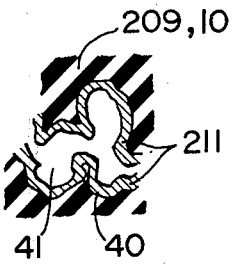

RECESS ELECTRODEPOSITING METHOD, ELECTRODE ASSEMBLY AND APPARATUS

FIELD OF THE INVENTION

The present invention relates in general to electrodepositing on a recessed workpiece or on a workpiece surface having a recess, or especially but not exclusively on an angularly indented area therein and, more particularly, to a method of forming an electrodeposited metallic layer on a wall of a recess in a workpiece and at least on a bottom wall portion of the entire surface of the recess and of the entire surface of the workpiece. The invention is also concerned with an electrode assembly and an apparatus for carrying out the method described. The term "workpiece" is herein intended to refer to an article on which a metallic layer or film is electrodeposited for permanent retention thereon (electroplating) and a pattern or model on which such a layer or film is electrodeposited for subsequent removal therefrom (electroforming) for the purpose of providing an electroerosive machining (EDM, ECM or ECDM) electrode or any other application. Thus, the term "workpiece" is herein intended to generally refer to a metallic or metallized substrate for receiving such a layer or film thereon, irrespective of its desired end use.

BACKGROUND OF THE INVENTION

In the art of electroplating and electroforming for forming an electrodeposited layer or film on a metallic or metallized substrate or workpiece, it is practically always desirable that the layer or film be formed uniformly on a desired surface area thereof. Depending upon the particular configuration of a selected receiving surface of a workpiece, however, it is generally difficult to assure a uniform distribution of potential gradients over the selected workpiece surface. There are surface areas on which an electrodeposit is barely formed as well as surface area on which the deposit is formed selectively or with a greater rate. The selective or preferential formation of electrodeposit on a certain area in the initial stage causes a further unbalance in the distribution of potential gradients so that in the subsequent stage the deposit is concentrated on that area and practically no further deposit is created on the other areas.

In order to solve this problem, various proposals have been made heretofore and include the use of a plurality of anodic electrodes designed and arranged in accordance with the particular surface configuration of the workpiece, the use of one or more auxiliary electrodes, the controlled delivery of an electrodepositing liquid electrolyte and the use of one or more masking plates in an attempt to create the distribution of potential gradients of a greater uniformity and to locally modify the thickness of the electric double layer.

Not only are these provisions complicated and inconvenient, it has been found that they are completely not satisfactory to produce an electrodeposited layer of uniform thickness depending on the particular configuration of the receiving workpiece surface. Difficulties especially arise in the deposition on a deep recess or a surface including a deep or angularly intended area are, especially uniformly on the entire wall of an angular recess and yet particularly on the bottom wall portion of an angular recess or indented area having an acute cross-sectional angle.

OBJECTS OF THE INVENTION

It is accordingly a general object of the present invention to overcome the aforementioned problem encountered in the prior art.

Specifically, the invention seeks to provide a novel, effective and yet efficient method of uniformly forming an electrodeposited metallic film on a wall of a recess in a workpiece having the recess, which method allows effective and yet efficient electrodeposition at least on an bottom wall portion of such a recess or of an angularly indented area of the entire surface of the recess having one or more such areas in the workpiece and which method allows a uniform deposition on the entire wall of the recess selectively or as well as on an area surrounding the recess in the workpiece.

The invention also seeks to provide a novel electrodepositing electrode assembly and an apparatus for carrying out the method described.

SUMMARY OF THE INVENTION

In accordance with the present invention, in a first aspect thereof, there is provided a method of forming an electrodeposited film on a wall of a recess in a workpiece and at least on a bottom wall portion of at least one angularly or otherwise indented area of the entire surface area of the recess, which method comprises the steps of: (a) preparing an electrodepositing electrode assembly comprising at least one electrodepositing electrode element and a support member so formed as to contain the electrode element therein and have a surface contour complementary to the surface contour of the recess in said workpiece, the said support member comprising a porous mass composed at least in part of an electrically nonconductive material and having abrasive particles distributed therein at least along the said contoured surface thereof; (b) positioning the said electrodepositing electrode assembly and the workpiece to establish generally a mating engagement of the said support member with the recess; (c) supplying an electrodepositing liquid electrolyte onto the said wall of the recess; (d) reciprocating at least one of the said electrode assembly and the workpiece so as to repetitively bring the said support member into contact with and away from the surface of the recess in mating engagement therewith; and passing an electrodepositing electric current between the said electrode element and the workpiece at least during a time period in which the said support member and the surface of the recess are brought together in step (d) to electrodeposit a metal from the liquid electrolyte at least on the said bottom wall portion in the said recess.

The invention also provides an electrodepositing electrode assembly for forming a metallic film on a wall of a recess in a recessed workpiece and at least on a bottom wall portion of such a recess or of an angularly or otherwise indented area of the entire surface area of the recess, which assembly comprises: at least one electrodepositing electrode element and a support member so formed as to contain the electrode element and have a surface contour complementary to the surface contour of the said recess in the workpiece, the said support member comprising a porous mass composed at least in part of an electrically nonconductive material and having abrasive particles distributed therein at least along the said contoured surface thereof.

The invention further provides an apparatus for forming an electrodeposited metallic film on a wall of a recess in a workpiece and at least on a bottom wall portion of at least one angularly or otherwise indented area of the entire surface area of the recess, which apparatus comprises: an electrodepositing electrode assembly comprising at least one electrodepositing electrode element and a support member so formed as to contain the said electrode element therein and having a surface contour complementary to the surface contour of the recess in the workpiece, the said support member comprising a porous mass composed, at least in part, of an electrically nonconductive material and having abrasive particles distributed therein at least along the said contoured surface thereof; means for positioning the said electrode assembly and the workpiece to establish generally a mating engagement of the said support member with the recess; liquid-delivery means for supplying an electrodepositing liquid electrolyte onto the wall of the recess; drive means for reciprocating at least one of the said electrode assembly and the workpiece so as to repetitively bring the said support member into contact with and away from the surface of the recess in mating engagement therewith; and a power supply for passing an electrodepositing electric current between the said electrode element and the workpiece at least during a time period in which the support member and the said surface of the recess are brought together to electrodeposit a metal from the liquid electrolyte at least on the said bottom wall portion in the recess.

The electrodepositing electrode element specifically may be in the form of a wire, rod or plate having one end electrically connected to one terminal (essentially positive) of the electrodepositing power supply and the other or active end which, when the support member is in mating engagement with the recess, lies in the proximity of the aforesaid bottom wall portion or an angularly dented area of the surface area of the recess. The other terminal of the power supply is, of course, electrically connected to the workpiece. When more than one such dented areas are present in the recess of the workpiece, a plurality of such electrode elements may be provided so that their active ends lie close to those areas, respectively.

The porous mass of electrically nonconductive material constituting the support member is, specifically, composed of a synthetic resin, say, of the phenolic family or the expoxy family and contains abrasive particles which may be of a substance selected from the group which consists of silicon carbide (SiC), boron carbide ($B_4C$), zirconium oxide ($Zr_2O_3$ or $ZrO_2$), aluminum oxide ($Al_2O_3$), silicon oxide ($SiO_2$), diamond and carbon. Powder particles of an electrically conductive material (metal, alloy or graphite) may be added in the porous mass to impart to the mass a limited electrical conductivity or a semiconductivity where desirable.

The invention also involves a method of preparing an electrodepositing electrode assembly described, which method comprises: forming a mixture of a synthetic resin and abrasive particles, and possibly also electrically conductive powder particles; applying the mixture onto or loading it into a workpiece pattern to form a yieldable mass of the mixture with a surface contour complementary to the surface contour of the workpiece; inserting one or more electrodepositing electrodes into the yieldable mass to a desirable depth or depths, respectively; and then solidifying the mass at a room temperature or by heating at an elevated temperature followed by cooling, thereby causing the electrode element or elements to be firmly held in the solidified mass.

The electrodepositing electrode element may alternatively or additionally, be in the form of an electrically conductive film composed of, say, copper or nickel chemically deposited or platinum, palladium or copper vapor-deposited, on the wall portions of the internal pores of the porous mass of essentially electrically nonconductive material, i.e. synthetic resin, having abrasive particles distributed therein. In this case, the abrasive particles are bonded with the synthetic resin of adhesive nature to form a porous abrasive mass which may be shaped using a workpiece or a model thereof as a shaping pattern and subsequently baked in a furnace.

BRIEF DESCRIPTION OF THE DRAWING

These and other objects and features of the present invention as well as advantages thereof will become more readily apparent from the following description made with reference to the accompanying drawing in which:

FIG. 4 is a similar view diagrammatically illustrating another form of the electrodepositing electrode assembly and a portion of an apparatus according to the invention;

FIG. 5 is a cross-sectional view diagrammatically illustrating another form of the electrodepositing electrode assembly in a working position for forming a uniform layer of electrodeposite over the entire surface area of a recess of V-shaped cross-section in a workpiece and on an area surrounding the recess; and FIG. 5A shows an electrode element in the form of a continuous metallic film;

SPECIFIC DESCRIPTION

Figure 1:
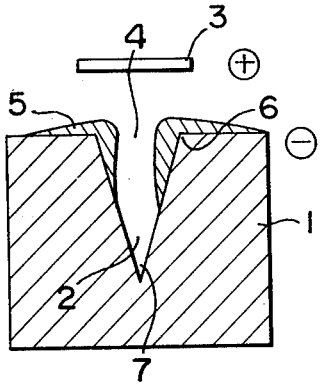
FIG. 1 is a cross-sectional view of a workpiece having a recess of a V-shaped cross-section and an uneven and undesirable format of electrodeposit formed on the workpiece with a conventional electrodepositing technique, in spite of the desire to form a layer of the electrodeposit uniformly over the entire surface area of the recess.

In FIG. 1 there is shown a workpiece 1 having a recess 2 of a V-shaped cross-section. The recess 2 may thus be either of conical shape or a V-shaped groove extending from the front to the rear of the sheet of drawing and having an equal width. Assuming, for example, that the recess 2 is of conical shape, it is apparent that with the conventional electrodepositing technique using a planar electrode 3 disposed above the opening 4 of the recess 2, electrodeposit 5 tends to build up selectively along and around the circular edge portion 6 at the recess opening 4, and gradually tapers off in thickness as the depth from the opening 4 increases. It is apparent that the edge portion 6 of the recess is the zone of lowest potential gradient and highest current density, and the narrow and angular bottom portion 7 of the recess 2 has the highest potential gradient and lowest current density so that very little or practically no plating occurs at the bottom portion 7. This problem is overcome in accordance with the present invention.

Figure 2:
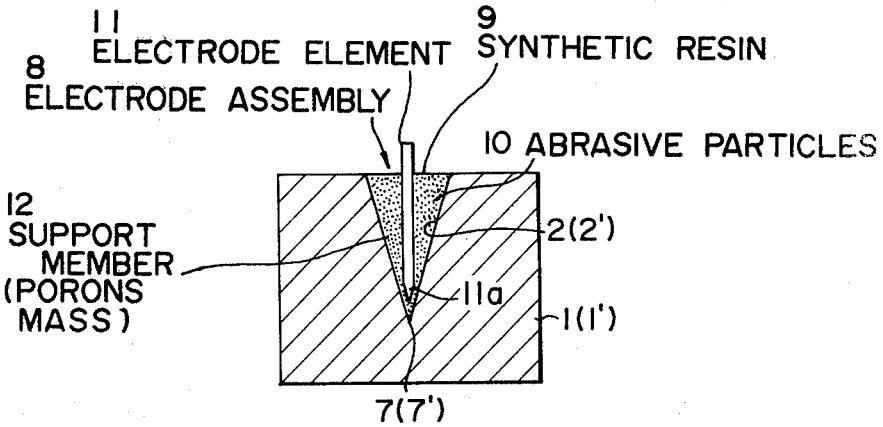
FIG. 2 is a cross-sectional view diagrammatically illustrating a similar workpiece and a novel electrodepositing electrode assembly of the innvention being formed using the surface contour of the workpiece as a pattern or the formed electrodepositing electrode assembly constituted as a part of the apparatus or used for carrying out the electrodepositing method according to the present invention.

FIG. 2 shows the workpiece 1 or a model 1′ prepared to duplicate the recess 2 of the workpiece 1 of V-shaped cross-section shown in FIG. 1 and a novel electrodepositing electrode assembly 8 of the invention formed by using the surface contour of the workpiece 1 or model 1′ as a shaping die. The assembly 8 is prepared by molding a mixture of synthetic resin 9 and abrasive particles 10 in the recess 2, 2′ and inserting an electrode element 11 which may be in the form of a rod, plate or wire so that its longitudinal axis preferably coincides with the axis of the conical recess 2, 2′ and its lower end 11*a* is positioned close to the angular bottom area 7, 7′ of the recess 2, 2′ where, as described, it is most difficult to form an electrodeposit with the conventional technique. The mixture 9, 10 having the electrode element 11 so positioned therein is solidified at a room temperature when the synthetic resin 9 is of adhesive nature (e.g. epoxy resin) or by heating to an elevated temperature followed by cooling to form a support 12 of porous. The support 12 in which the electrode element 11 is firmly held and which has the shape of the recess 2, is then removed from the workpiece 1 or model 1′. In the molding described, it is essential that the end portion 11*a* of the electrode element 11 be positioned in the proximity of but slightly spaced from the angular bottom area 7 (7′) so that there is no direct contact of the element 11 with the workpiece 1 in an electrodepositing operation which is to be described. As a result, it is possible that the end portion of the electrode element 11 in the support 12 removed from the workpiece 1 or model 1′ is covered with synthetic resin or abrasive particles or both. It is accordingly essential that the support 12 be formed so porous that the electrode element 11 can communicate with the exterior of the mass through interconnected pores and especially with the exterior at the end portion of the assembly 8. If synthetic resin and abrasive particles are present at that end portion and completely mask the end of the electrode element 11, they should be removed to allow electrical communication via a liquid electrolyte with the workpiece in the electrodepositing operation.

The electrode element 11, which may be in the form of a rod, plate or wire may have a width or thickness of 0.1 to 1 mm and may make use of copper or titanium plated with insoluble platinum or of an insoluble metal of the ferrite family or of graphite. A metal which dissociates into the electrolyte for electrodeposition may also be employed.

Abrasive particles 10 may be silicon carbide, boron carbide, boron nitride, aluminum oxide, zirconium oxide, silicon oxide, diamond or any other material conventionally used as abrasive Granular abrasive carbon particles may also be employed. Abrasive particles 10 may be of a particle size in the range between 0.01 and 0.3 mm and preferably of around 0.1 mm.

The synthetic resin 9 constituting the support 12 for the electrode element 11 and abrasive particles may be of epoxy family or the phenolic family and should be resistant to the liquid electrolyte and chemically stable. The proportion of synthetic resin 9 to abrasive particles 10 in the mass of the support 12 should be 5 to 40% by weight. With a proportion less than 5%, the mechanical strength becomes insufficient and with a proportion in excess of 40%, the abrasive density becomes unsatisfactory. A preferred example is mixing silicon carbide (SiC) of a particle size of 0.1 mm with a phenolic resin so that the abrasive is proportioned at 20% by weight relative to the resin. By heating the mixture to a temperature of 120° C. followed by cooling, a highly satisfactory porous support member 12 is obtained which allows electrodepositing current to be passed from the electrode element 11 supported therein to the workpiece 1 at a mean current density of 0.1 A/cm$^2$ in electrodepositing operation. Phenolic resin is thermally decomposed at a temperature of 500° C. and thermal decomposition allows silicon-carbide or other abrasive particles and the electrode element to be recovered for reutilization.

Figure 3:
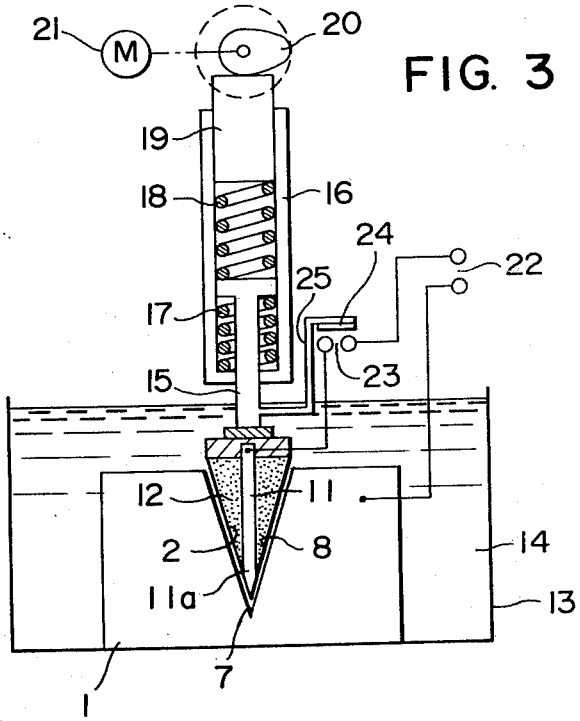
FIG. 3 is an elevational view essentially in section diagrammatically illustrating an apparatus according to the present invention.

In FIG. 3, a workpiece 1 having an angular recess 2 on the entire wall of which electrodeposit is to be uniformly formed is securely supported in a worktank 13 and immersed in a bath of liquid electrolyte 14 therein. The electrode assembly 8 according to the invention comprising an electrode element 11 and the support member 12 so constructed and formed as described in connection with FIG. 2 is shown so positioned the support 12 is in a mating engagement with the recess 2 of the workpiece 1. The assembly 8 is securely supported by a shank which is in the form of a piston 15 extending from a cylinder 16 fixed in position. The piston 15 is slidably movable in the cylinder 16 which accommodates a spring 17 tending to force the piston 15 and hence the electrode assembly 8 upwardly and a spring 18 tending to force the piston 15 and the electrode assembly 8 downwardly in cooperation with a pusher 19. A rotary cam 20 in abutting contact with the drive shaft 19 is rotated with its shaft by a motor 21 to reciprocate the pusher 19 axially in the cylinder 16. This in turn causes the piston 15 and hence the electrode assembly 8 to reciprocate axially, thereby cyclically bringing the assembly 8 and the support member 12 into direct mating engagement with the recess 2 and in pressure contact with the surface of the recess.

An electrodepositing power supply 22 is electrically connected on the one hand to the workpiece 1 in the sense to make it generally anodic and on the other hand via a switch 23 to the upper end of the electrode element 11 in the sense to make the latter generally cathodic. The power supply 22 supplies an electrodepositing current in the form of a direct current, a succession of pulses or any other known form between the electrode element 11 and the workpiece 1 via the liquid electrolyte 14. The switch 23 is periodically closed by a conducting plate 24 supported by the reciprocating piston 15 via an arm 25. The conducting plate 24 is here arranged to close the switch 23 each time the electrode assembly 8 and the workpiece 1 are brought together and the support member 12 is brought into a contacting relationship with the surface of the recess 2 in the workpiece 1 in the reciprocation cycles of the assembly 8. Each time the electrode assembly 8 is brought away from the surface of the recess 2 in the reciprocation cycles, the switch 23 is opened to disconnect the power supply 22 from the electrode element 11.

The contact pressure of the support 12 against the surface of the recess 2 may be adjusted by selecting elastic constants of the springs 17 and 18. It is also advisable to make the support 12 elastic by incorporating therein an elastic material, e.g. a synthetic rubber material to form a porous elastic support 12. The pressure contact force and conditions are in this case modified by elastic constants of the support 12 as well. It should be noted that an excessive pressure force is harmful because of the possibility that the electrodeposited layer on the surface of the recess 2 may be excessively ground off.

With the novel electrodepositing electrode assembly 8 according to the invention, it is essential that abrasive particles 10 be so contained in the support 12 as to be distributed therein and at least along the surface regions thereof. This feature, coupled with the feature that the support 12 is contoured complementarily with the surface contour of the recess 2, advantageously provides abrasive removal of the excessive build-up of electrodeposit on particular surface areas as described in connection with FIG. 1 in the course of operation by virtue of reciprocation of the assembly and its pressure contact against the recess surface. Thus, in the electrodepositing operation, no excessive build-up of electrodeposit occurs or remains beyond a desired thickness in any area on the entire surface of the recess 2. Furthermore, since the electrode element 11 is firmly embedded in the abrasive support member 12 and so arranged as described and is moved in reciprocation therewith, the active electrode and 11*a* comes periodically into direct proximity of the bottom area 7 of the recess 2 to reliably produce electrodeposit on the latter area with the electrodeposition current applied across the narrow gap selectively during each proximity time period in the successive mechanical reciprocation cycles. In addition, the reciprocation of the electrode assembly 8 causes a highly effective pumping action for the liquid electrolyte and keeps it renewed consecutively in the bottom area 7 of the recess 2. While one or more external nozzles designed to direct a stream or streams of the fresh liquid electrolyte into the recess 2 may be arranged or the electrode element may be made tubular to direct such a stream into the bottom area 7 and elsewhere in the recess 2, these measures are generally not required. When these measures are employed, it is advisable to synchronize the forced delivery of the liquid electrolyte in a stream with the retraction of the assembly 8 in each reciprocation cycle.

When a uniform layer of electrodeposit is formed over the entire surface of the recess 2 in this manner and builds up to a certain small extent in an initial stage of the operation, the layer then is capable of continuingly building up uniformly over the entire surface. Thus, upon completion of the initial stage, it is possible to terminate the electrodepositing operation with the electrode assembly 8 and apparatus of the invention and then to continue the electrodepositing operation with a plate electrode (as shown at 3 in FIG. 1) or with a simple rod or plate electrode inserted in the recess 2 in a conventional electrodeposition arrangement. When it is desirable to form a layer of electrodeposit to a substantial thickness with the arrangement of the invention, the cylinder 16 should be moved upwardly or retracted at a rate of deposition while permitting the piston 15 and the assembly 8 to continue to reciprocate or without reciprocation of the assembly 8.

The reciprocation of the electrode assembly 8 according to the invention should have a rate of reciprocation of 0.01 to 100 Hz or cycles per second and an amplitude of reciprocation ranging between 0.1 and 100 mm. With the embodiment shown, the rate of reciprocation is determined by the rate of rotation of the motor 21 and the amplitude of reciprocation is determined basically by the shape and dimensions of the cam 20. For example, the electrode assembly 8 may in an electrodepositing operation be reciprocated with a rate of 2 cycles per second and an amplitude of 10 mm. It has been formed that this allows an electrodeposition current to be thrown or supplied at a current density of 0.1 $A/cm^2$ to yield a rate of electrodeposition of 0.16 mm/hour.

As described previously, in order to form electrodeposit uniformly over the entire surface of the recess in the process of this invention, it is essential that the supporting member 12 be so porous that substantially all pores therein are interconnected and previous with the liquid electrolyte and that the electrode element 11 in effect communicates throughout its entire length or area with the exterior surface areas of the support 12. Where it is desirable to electrodeposition only a selected area of the entire surface area of the recess 2, a masking film of electrically insulating material may be applied to that area or those areas of the recess 2 not to be coated. Only the bottom area 7 of the recess 2 where it is difficult to electrodeposit with the conventional technique can, however, be selectively electrodeposited without such a masking, by making the support member 12 non-porous or substantially free from the interconnected pores or impervious to liquid and having only the tip portion 11*a* of the electrode element 11 exposed to the exterior of the surface of the support 12.

It will be understood that modified forms of the reciprocation of the electrode assembly 8 are possible. For example, a small-amplitude and high-frequency reciprocation may be superimposed upon a high-amplitude and low-frequency reciprocation. Further, one of the electrode assembly 8 or the workpiece 1 while either one is being reciprocated in the manner described may be rotated about the axis of the assembly and this applies particularly where the recess 2 and the support member 12 are conical. It should also be noted that the reciprocation may not be limited to a vertical or axial reciprocation.

FIG. 4 shows another form of the electrodepositing electrode assembly 108 of the invention designed for use with a workpiece 101 having a recess 102 of intricate shape or possessing a multiplicity of sub-recesses or dented areas 107-1, 107-2, 107-3 and 107-4. The electrode assembly 108 comprises a support 112 formed here as a layer composed of synthetic resin 9 and abrasive particles 10 distributed therein. The support 112 is securely supported by a backing member 30 of electrically insulating material which is in turn securely supported by a carriage 31. In preparing the assembly 108, the support 112 is first molded generally in the manner previously described with the workpiece 101 or a model thereof as a shaping die and is thereby shaped with a surface contour complementary to the surface contour of the workpiece 101. In the molding step, a plurality of electrode elements 111-1, 111-2, 111-3 and 111-4 are inserted in the support 112 and fixed therein generally in the manner already described. Additional molding is then carried out to mold the backing member 30 on the support 112 to form the assembly 108 shown. The electrodes are shown electrically connected to one terminal (generally positive) of the power supply 22 and the workpiece 101 to the other terminal (generally negative) of the power supply 22 for uniform electrodeposition on the entire surface of the recess 102 including sub-recesses 107-1, 107-2, 107-3 and 107-4 and an area surrounding the recess 102. The entire electrode assembly 108 is reciprocated, during the electrodepositing operation, by means of a drive unit 32 which may be of the type previously described.

FIG. 5 shows a further form of the electrodepositing electrode assembly 208 of the invention shaped and positioned in a mating engagement with the recess 2 in the workpiece 1 for uniform electrodeposition on the entire surface of the recess 2 and on an area surrounding the recess 2. The support 212 is here constituted by a porous mass of abrasive particles 10 and nonconductive binder material 209 which may be an adhesive synthetic resin. The support 212 contains an electrode element which is here in the form of a continuous metallic film formed by chemical or vapour deposition on the wall portions 40 of the interconnected pores 41 in the mass 209, 10 as shown in FIG. 5A. The electrode assembly 208 is securely supported by a shank or piston 215 as in the embodiment of FIG. 3. The electrodeposition power supply 22 has one output terminal 22A (generally positive) electrically connected to the conductive shank 215 and the other output terminal 22B (generally negative) electrically connected to the workpiece 1. The output current of the power supply 22 is thus passed from the terminal 22A via the conductor 215 and the electrode element 211 in the support member 212 and through the liquid electrolyte bridging the element 211 and the workpiece 1 to the terminal 22B to electrodeposite metal over the entire surface of the recess 2 and the area surrounding the recess 2. During the depositing operation, the electrode assembly 208 is reciprocated by a drive unit of the type shown in FIG. 3 to periodically bring the surface thereof into direct machining engagement and pressure contact with the surface of the recess generally in the manner already described to assure uniformity in thickness of the electrodeposited layer of metal on the entire surface area of the recess 2. As the thickness of the electrodeposit increases, the mean position of the electrode assembly 208 in reciprocation is displaced upwardly at a rate of increase in the thickness of the electrodeposit. Alternatively or in addition, here again, the operation with the assembly 208 may be terminated when the thickness reaches a certain extent. The assembly 208 may then be replaced by a conventional rest plate or rod electrode to continue the depositing operation until a desired greater thickness is achieved. It should be apparent that in the assembly 208 shown in FIG. 5, the support 212 may additionally incorporate a further electrode element in the form of a wire, rod or plate as shown at 11 in FIGS. 2 and 3 and arranged in the manner described.

Figure 6:
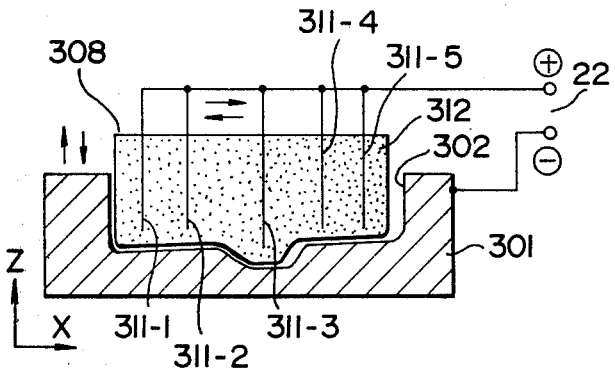
FIGS. 6 and 7 are elevational and top plan views, respectively, of a workpiece having a recess and an electrodepositing electrode assembly working on the workpiece in a modified mode of the method according to the invention.
Figure 7:
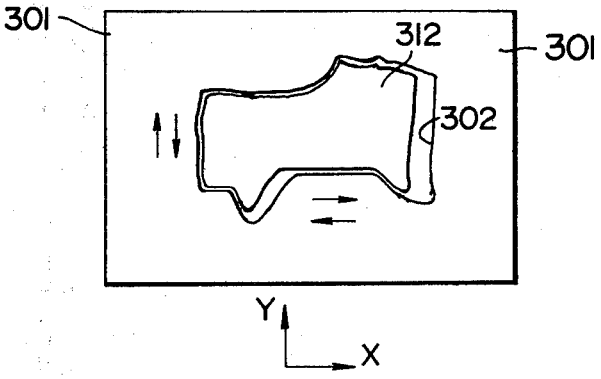

The electrode assembly 308 shown in FIG. 6 comprises a support 312 composed and constructed generally in the same manner as described in connection with the previous FIGURES but slightly undersized with respect to the contour of a large recess 302 in a workpiece 301. The top plan view of the recess 302 and the workpiece 301 are shown in FIG. 7. In this embodiment, the reciprocation of the electrode assembly 308 is effected not only in the direction of the vertical or Z-axis but in the direction of x- or y-axis or both directions in the horizontal plane. The horizontal reciprocation may be replaced by an orbital movement whereby each point in the assembly 308 is moved along a circular path of an equal small radius. A multiplicity of electrodes elements 311-1, 311-2, 311-3, 311-4 and 311-5 are embedded in the support 312 and arranged and positioned therein in a manner as hereinbefore described.

What is claimed is:

1. A method of forming an electrodeposited metallic layer on a wall of a recess in a workpiece and at least on a bottom area in the recess, said method comprising the steps of:

(a) preparing an electrodepositing electrode assembly comprising an electrodepositing electrode element and a support member so formed as to contain said electrode element therein and have a surface contour complementary to a surface contour of said recess in said workpiece, said support member comprising a porous mass composed at least in part of an electrically non-conductive material and having abrasive particles distributed therein at least along said contoured surface thereof;

(b) positioning said electrodepositing electrode assembly and said workpiece to establish generally a mating engagement of said support member with said recess;

(c) supplying an electrodepositing liquid electrolyte onto said wall of said recess;

(d) reciprocating at least one of said electrode assembly and said workpiece so as to repetitively bring said support member into contact with and away from the surface of said recess in the mating engagement therewith; and (e) passing an electrodepositing electric current between said electrode element and said workpiece at least during a time period in which said support member and said surface of the recess are brought together in step (d) to electrodeposit a metal from said liquid electrolyte at least on said bottom area in said recess.

2. A method as defined in claim 1 wherein the recess has a plurality of dented areas and the assembly comprises a plurality of such electrodes so situated that when the support member is in mating engagement with said dented areas their second ends lie close to those areas, respectively.

3. The method defined in claim 1 wherein said porous mass is composed of a synthetic resin.

4. The method defined in claim 1 wherein the synthetic resin is of the phenol or epoxy family.

5. The method defined in claim 6 wherein the abrasive particles are of at least one substance selected from the group consisting of silicon carbide, boron nitride, zirconium oxides, aluminum oxide, silicon oxide, diamond and carbon.

6. The method defined in claim 7 wherein particles of electrically conductive material are added to the porous mass to impart to the mass a limited electrical conductivity or a semi-conductivity.

7. The method defined in claim 1 wherein the electrode element is in the form of an electrically conductive film deposited on the wall portions of the interconnected pores of said porous material.

8. The method defined in claim 9 wherein the film is composed of chemically deposited copper or nickel or vapor-deposited platinum, palladium or copper.

9. The method defined in claim 9 wherein the synthetic resin is of adhesive nature and the abrasive particles are bonded therewith to form a porous abrasive mass.

10. The method defined in claim 1 wherein the porous mass is shaped using the workpiece, or a model thereof, as a shaping pattern or mold whereupon the mass is solidified at a room temperature or by heating at an elevated temperature followed by cooling.

11. The method defined in claim 1 wherein the surface contour of said assembly is smaller than the surface contour of the recess.

12. An apparatus for forming an electrodeposited metallic layer on a wall of a recess in a workpiece and at least on a bottom area in the recess, the apparatus comprising:

an electrodepositing electrode assembly comprising an electrodepositing electrode element and a support member so formed as to contain said electrode element therein and have a surface contour complementary to a surface contour of said recess in said workpiece, said support member comprising a porous mass composed at least in part of an electrically nonconductive material and having abrasive particles distributed therein at least along said contoured surface thereof;

means for positioning said electrodepositing electrode assembly and said workpiece to establish generally a mating engagement of said support member with said recess;

liquid-delivery means for supplying an electrodepositing liquid electrolyte at least onto said wall of said recess;

drive means for reciprocating at least one of said electrode assembly and said workpiece so as to repetitively bring said support member into contact with and away from the surface of said recess in mating engagement therewith; and power supply means for passing an electrodepositing electric current between said electrode element and said workpiece at least during a time period in which said support member and said surface of the recess are brought together to electrodeposit a metal from said liquid electrolyte at least on said bottom area in said recess.

* * * * *